US010072501B2

(12) United States Patent
Sollami

(10) Patent No.: US 10,072,501 B2
(45) Date of Patent: Sep. 11, 2018

(54) BIT HOLDER

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 14/512,581

(22) Filed: Oct. 13, 2014

(65) Prior Publication Data

US 2015/0028656 A1 Jan. 29, 2015

Related U.S. Application Data

(63) Continuation-in-part of application No. 12/870,289, filed on Aug. 27, 2010, now Pat. No. 8,622,482.

(60) Provisional application No. 61/891,683, filed on Oct. 16, 2013.

(51) Int. Cl.
*E21C 35/19* (2006.01)
*E21C 35/18* (2006.01)

(52) U.S. Cl.
CPC ..... *E21C 35/18* (2013.01); *E21C 2035/1826* (2013.01); *E21C 2035/191* (2013.01)

(58) Field of Classification Search
CPC ..... E21C 35/18; E21C 35/19; E21C 35/193; E21C 35/1933; E21C 35/197
USPC ..... 299/100–113
See application file for complete search history.

(56) References Cited

U.S. PATENT DOCUMENTS 3,397,012 A 8/1968 Krekeler
3,519,309 A 7/1970 Engle
3,865,437 A 2/1975 Crosby
4,084,856 A 4/1978 Emmerich
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A * 12/1985 Beebe ..... E21C 35/197 299/104
4,570,726 A 2/1986 Hall
4,604,106 A 8/1986 Hall
4,694,918 A 9/1987 Hall
4,811,801 A 3/1989 Salesky
(Continued)

FOREIGN PATENT DOCUMENTS

DE 19611455 a1 * 9/1996
DE 19611455 a1 * 9/1996
(Continued)

OTHER PUBLICATIONS

Internet Article "Steep Tapers & Fast Tapers: AT3 and What It Means", 4 pages, Oct. 27, 2016.*
(Continued)

*Primary Examiner* — Sunil Singh

(74) *Attorney, Agent, or Firm* — Mercedes V. O'Connor; James N. Videbeck; Rockman Videbeck & O'Connor

(57) ABSTRACT

An improved bit holder includes a larger bit shank bore and an enlarged upper shank segment or band with a taper of up to 7 degrees per side that provides an interference fit between the top of the shank and top of the bit block bore when the bottom of the bit holder body seats on the top of the bit block bore. An annular tapered void adjacent the bit holder tire portion provides for ease of bit holder extraction.

13 Claims, 2 Drawing Sheets

(56) References Cited

U.S. PATENT DOCUMENTS 4,818,027 A 4/1989 Simon
4,844,550 A 7/1989 Beebe
4,915,455 A 4/1990 O'Niell
4,944,559 A 7/1990 Sionett
5,067,775 A 11/1991 D'Angelo
5,088,797 A * 2/1992 O'Neill ..... E21C 35/197 175/413
5,098,167 A 3/1992 Latham
5,159,233 A * 10/1992 Sponseller ..... H01T 21/02 313/141
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,370,448 A * 12/1994 Sterwerf, Jr. ..... E21C 35/197 175/413
5,374,111 A 12/1994 Den Besten
5,415,462 A 5/1995 Massa
5,417,475 A 5/1995 Graham et al.
5,458,210 A 10/1995 Sollami
5,492,188 A 2/1996 Smith et al.
5,607,206 A * 3/1997 Siddle ..... E21C 35/19 299/102
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 6/2001 Sollami
6,331,035 B1 * 12/2001 Montgomery, Jr. .... E21C 35/18 299/102
6,357,832 B1 3/2002 Sollami
6,371,567 B1 * 4/2002 Sollami ..... B28D 1/188 299/104
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 * 8/2008 Hall ..... E21C 35/183 299/111
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 * 10/2009 Hall ..... E21C 35/183 299/104
7,628,233 B1 12/2009 Hall
7,635,168 B2 12/2009 Hall
7,637,574 B2 * 12/2009 Hall ..... E21C 35/183 299/104
7,648,210 B2 * 1/2010 Hall ..... E21C 35/1933 299/104
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 * 5/2015 Bookhamer ..... E21C 35/197 299/104
9,039,099 B2 5/2015 Sollami
9,316,061 B2 4/2016 Hall
2002/0074850 A1 * 6/2002 Montgomery, Jr. .. E21C 35/197 299/102
2002/0074851 A1 * 6/2002 Montgomery, Jr. .. E21C 35/197 299/107
2002/0167216 A1 11/2002 Sollami
2003/0015907 A1 1/2003 Sollami
2004/0004389 A1 1/2004 Latham
2006/0071538 A1 4/2006 Sollami
2006/0186724 A1 8/2006 Stehney
2008/0035386 A1 * 2/2008 Hall ..... E21C 35/183 175/425
2008/0036276 A1 * 2/2008 Hall ..... E21C 35/183 299/104

(56) References Cited

U.S. PATENT DOCUMENTS

| | | | | |
|---|---|---|---|---|
| 2008/0067859 | A1* | 3/2008 | Hall | E21C 35/183 299/102 |
| 2009/0200857 | A1* | 8/2009 | Hall | A47C 3/00 299/104 |
| 2009/0261646 | A1 | 10/2009 | Ritchie et al. | |
| 2010/0244545 | A1 | 9/2010 | Hall | |
| 2010/0253130 | A1 | 10/2010 | Sollami | |
| 2011/0006588 | A1 | 1/2011 | Monyak et al. | |
| 2011/0089747 | A1* | 4/2011 | Helsel | B28D 1/188 299/104 |
| 2011/0204703 | A1 | 8/2011 | Sollami | |
| 2011/0254350 | A1 | 10/2011 | Hall | |
| 2012/0027514 | A1 | 2/2012 | Hall | |
| 2012/0038203 | A1 | 2/2012 | Hall | |
| 2012/0068527 | A1 | 3/2012 | Erdmann | |
| 2012/0181845 | A1 | 7/2012 | Sollami | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1* | 12/2012 | Swope | E21C 35/197 299/104 |
| 2013/0169023 | A1 | 7/2013 | Monyak | |
| 2014/0326516 | A1 | 11/2014 | Haugvaldstad | |
| 2015/0028656 | A1 | 1/2015 | Sollami | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0315910 | A1 | 11/2015 | Sollami | |
| 2015/0354285 | A1 | 12/2015 | Hall | |
| 2016/0194956 | A1 | 7/2016 | Sollami | |
| 2017/0089198 | A1 | 3/2017 | Sollami | |

FOREIGN PATENT DOCUMENTS

| | | |
|---|---|---|
| DE | 102011079115 | 1/2013 |
| DE | 102015121953 | 7/2016 |
| DE | 102016118658 | 3/2017 |
| GB | 2483157 | 2/2012 |
| WO | 2008105915 A2 | 9/2008 |
| WO | 2008105915 A3 | 9/2008 |
| WO | 2009006612 | 1/2009 |

OTHER PUBLICATIONS

Internet Article OT—Theory of a self holding taper?, 7 pages, Oct. 27, 2016.*

* cited by examiner

BIT HOLDER

This application claims priority to U.S. Provisional Application No. 61/891,683, filed Oct. 16, 2013. This application is a continuation-in-part of U.S. Non-provisional application Ser. No. 12/870,289, filed Aug. 27, 2010, now U.S. Pat. No. 8,622,482, issued Jan. 7, 2014, to the extent allowed by law and the contents of which are incorporated herein by reference in their entireties.

This invention relates to road milling, mining and trenching equipment and, more particularly, to an improved bit holder used in road milling.

BACKGROUND OF THE INVENTION

With the invention of the present applicants quick change bit holder as disclosed in U.S. Pat. No. 6,585,326, issued Jul. 1, 2003, the combination of bits and their respective bit holders whether separate pieces or combined into a unitary structure, no longer needed threaded nuts or retaining rings to maintain the structure on a bit block as part of a rotating drum or endless chain type of bit assembly mechanism. The respective shanks of the bit/holder combinations were generally cylindrical in shape, hollow with a thick generally annular side wall and slotted on a distal portion of that side wall in an axially inward direction allowing for radial compression when inserted in a bit block bore having sufficient radial force between that shank and bore to maintain the bit holder in the bit block during use.

In the preferred embodiment, the bit block bore would be tapered in a non-locking taper configuration approximating one degree of taper per side and the shank of the bit holder would likewise be tapered along a portion of its length such that the insertion of the bit holder shank in the bit block bore need only be forced approximately ½ to 1¼ inch to mount the bit holder shank in the bit block bore.

Differing configurations made by others utilizing applicant's basic invention were, secondly, configured with either near a perfectly cylindrical bit block bore and a cylindrical distal end of the slotted bit holder shank. Such a configuration required forcing the bit holder shank into the bit block bore a distance of about two inches to retain the assembly together during use.

A third configuration was developed utilizing a bit block bore that at approximately its outer ½ axial length included a frustoconical shape taper approximating 5.5 degrees per side with the inner portion of its axial length being cylindrical in shape. The distal end half of the bit holder shank was slotted in a configuration useful with the third type of bit block bore. The present applicant's prior application Ser. No. 12/870,289 disclosed a bit holder shank in FIG. 12 capable of being retained in the third type of bit block bore, namely, the inner half being cylindrical and the outer half being tapered with FIGS. 13 and 14 showing that same bit holder shank being inserted in a bit block having a slight (one degree per side) constant taper bore.

The invention shown in the previously mentioned FIG. 12 of the '289 application discloses an upper portion of the bit holder shank immediately adjacent the upper bit holder body rear annular flange which does not contact the upper portion of the bit holder shank of the tapered bit block bore, but does have the rear annular flange contacting the upper flat horizontal surface of the bit block.

Competitive bit holder/bit block combinations were constructed such that when the bit holder shank was mounted in the bit block bore, the rear annular flange of the bit holder body would be spatially related to the upper surface of the bit block.

A need has developed for a new and improved bit holder shank capable of operating in the multiple bit holder bore configurations.

SUMMARY OF THE INVENTION

The invention resides in a bit holder comprising a bit holder body and a generally cylindrical shank depending from the bottom of the bit holder body, the shank including an upper portion generally closely subjacent a bottom of the bit holder body, the upper portion including an outer taper surface up to 7.0 degrees per side with a central axis of the bit holders and axial height of the upper portion being between about ½ inch and ⅞ inch.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings where like numerals refer to like parts, and in which:

DETAILED DESCRIPTION OF THE PREFERRED EMBODIMENT

Figure 2:
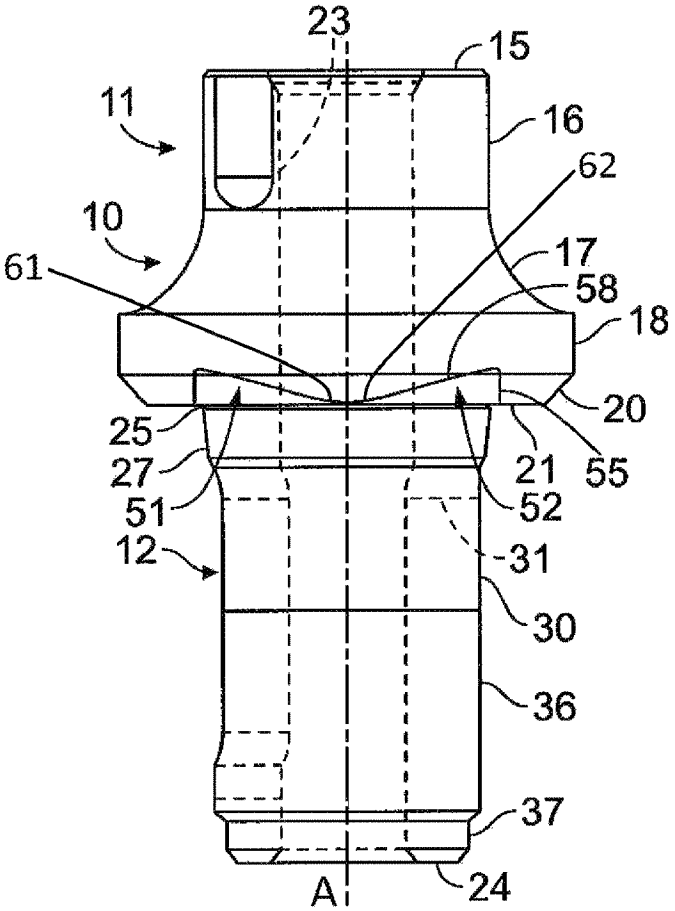
FIG. 2 is a vertical elevational side view of the bit holder of the present invention shown in FIG. 1.
Figure 1:
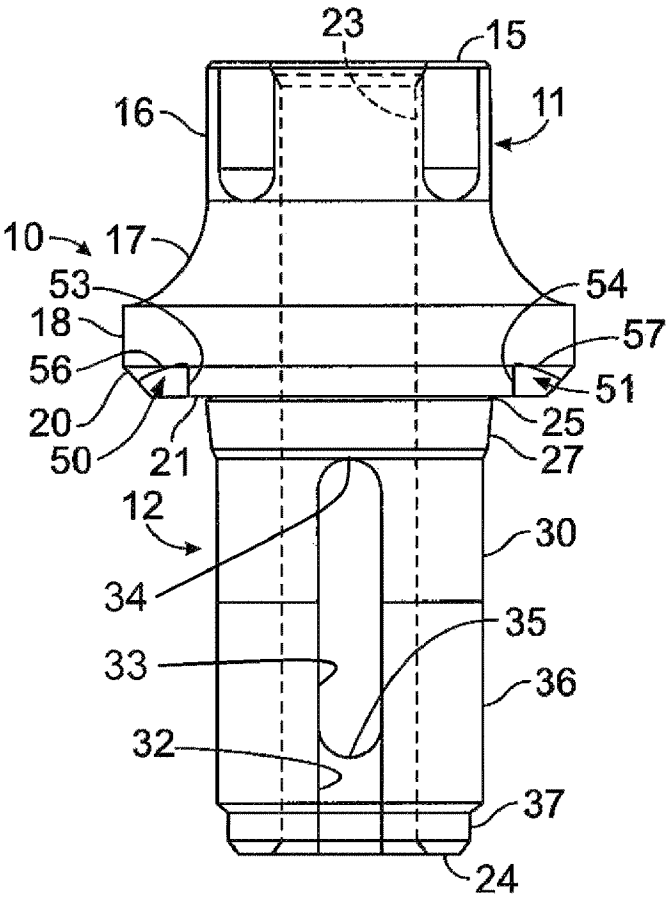
FIG. 1 is a vertical elevational front view of an improved bit holder constructed in accordance with the present invention.
Figure 3:
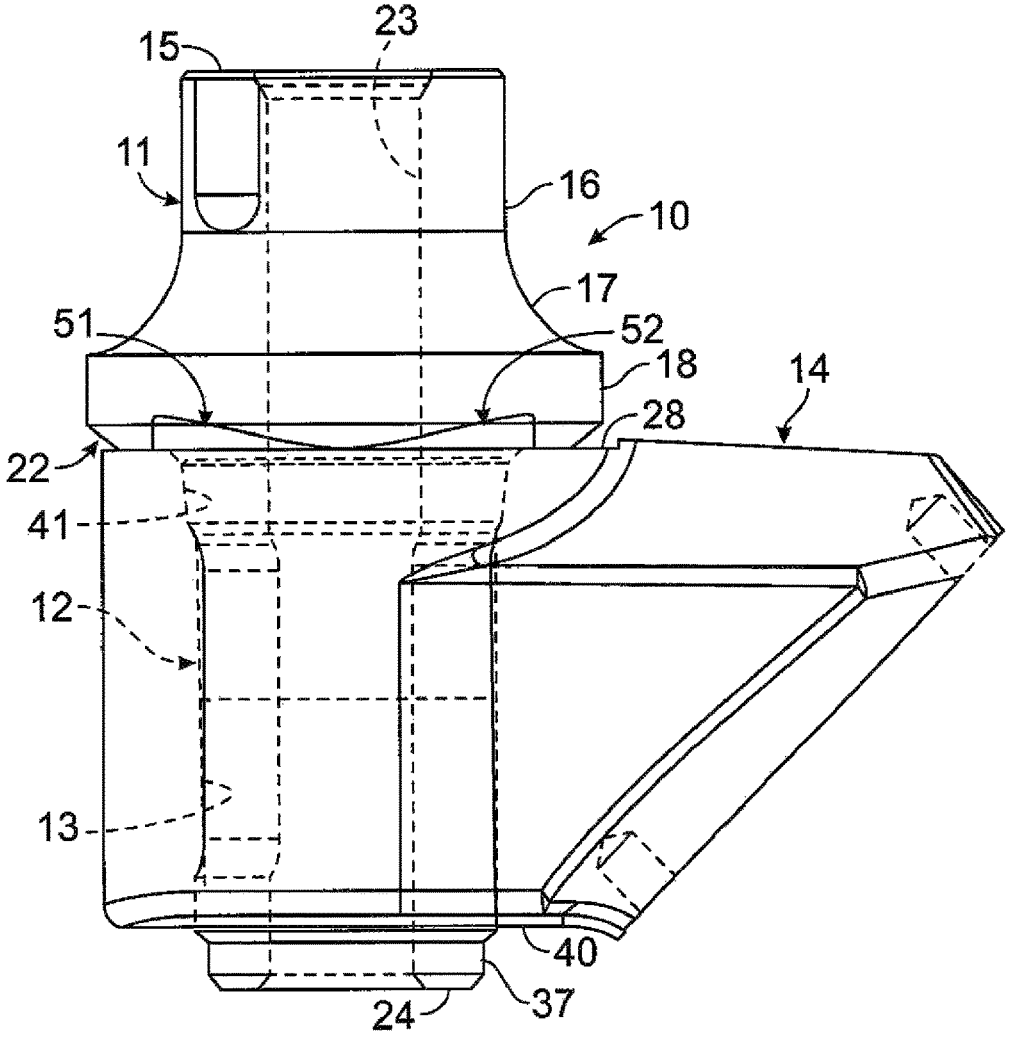
FIG. 3 is a vertical elevational side view of the combination bit holder and bit block with the improved bit holder shown as inserted in the bit block bore with the bit holder shank shown in dotted line.

Referring to FIGS. 1, 2 and 3, a bit holder, generally indicated at 10, constructed in accordance with the present invention includes what would be termed a "beefed up" bit body 11 adjacent the top thereof and a generally cylindrical shank 12 depending from the bottom of the bit holder body. As shown most clearly in FIG. 3, the bit holder shank is sized to fit within a bore 13 in a bit block 14, to be discussed in more detail below.

Referring again to FIGS. 1 and 2, the bit holder body 11 is generally annular in shape having a flat annular top surface 15, a generally cylindrical upper portion 16 a nominal 1¾ inches in diameter extending axially approximately 1 inch downward from the top surface 15. Subjacent the extended cylindrical top portion is a flared middle portion 17, in this preferred embodiment having a concave side surface that extends axially and downwardly and radially outwardly to what is termed in the art as a "tire portion" 18 which is generally circular and is the widest radially extending portion of the bit holder. The tire portion approximates ½ inch in axial dimension with a diameter of about 2⅝ inches. At the bottom of the tire portion is constructed in accordance with this preferred embodiment is a 45 degree tapered portion 20 ending in a flat annular rear flange 21 of the body.

Again, as shown most clearly in FIG. 3, this 45 degree angular tapered portion 20 provides, when the bit holder is fully mounted in the bit block, a hollowed out area between the bottom annular flange 21 of the bit holder body 11 and the top flat surface of the bit block providing a space 22 in which an extraction tool (not shown) may be inserted and utilized to easily remove the bit holder 10 from the bit block 14. Two pair of tapered undercuts 50-51 (only 52 shown) are formed in the tire portion adjacent the outer surface thereof for providing a hollow area in which the tapered tines of a fork (not shown) may be inserted to provide for extraction of the combined tip/bit holder (not shown) from the top of the bit block. The wedge cutouts 50, 51 and 52 preferably each include a flat vertical inside surface 53, 54 and 55 parallel with each other, respectively, a flat 15 degree tapered top or roof surface 56, 57, and 58, respectively. The outside edge of surfaces 56, 57 and 58 are arcuate in shape and follow the periphery of the tire portion. The interior border, or declining terminus 60 (not shown), 61 (FIG. 2), 62 (FIG. 2), respectively, of each wedge does not extend to a plane, shown extending through an axis A of the bit holder body in FIG. 2, through the centerline of the holder. A single tool (not shown) with tapered tines approximating ⅛ inch in thickness on the distal end and about ⅞ inch thickness on the central bight portion is sufficient to extract the bit holder from the bit block.

Subjacent the bit holder body 11, is the generally cylindrical shank 12 of the bit holder 10. It should be noted that both the bit holder body and the bit holder shank include a central bore 23 positioned therethrough which runs from the annular flat top surface 15 of the bit holder body to the distal end 24 of the bit holder shank 12.

In the preferred embodiment, this bore approximates 0.780-0.786 inch in diameter, the importance of which will be discussed below.

Depending from the rear annular flange 21 of the bit holder body 11 is the generally cylindrical hollow shank 12. The top portion of the shank may include a rounded junction 25 between the bit holder body 11 and the shank 12 which is provided to avoid sharp corners which may provide an area for stress cracks to begin. Subjacent this rounded area is an increased diameter top shank portion 27, larger than heretofore utilized in applicant's bit holders. This increased diameter portion 27 completely fills a void such as shown in FIG. 12 of applicant's co-pending application Ser. No. 12/870,289 for an approximate ½ to ⅞ inch upper shank axial length. The outer diameter of the upper tapered segment is 0.000 to 0.003 inch larger than the corresponding outer distal diameter of the bit block bore thus preferably providing a non-locking 5.5 degree per side preferred taper interference fit with the bit block bore 13. A non-locking taper is defined as achieving continuous axial movement when the same force is applied to initially insert the shank of the holder into the bit holder block bore.

As shown most clearly in FIG. 3, this interference fit is provided with the annular bottom flange 21 of the bit holder body 11 resting on the top flat surface 28 of the bit block 14 when mounted therein.

Subjacent the increased diameter upper shank portion 27 is a mediate decreased diameter shank segment 30 which, when the bit holder 10 is mounted in the bit block 14, is sized to not contact the bit block bore 13. In this decreased diameter mediate segment 30 is found the upper termination 31 of the longer bit shank slot 32 that extends from the upper mediate 30 portion through to the distal end 24 of the bit holder shank 12. Diametrically opposing this substantially through slot 32 is a shorter enclosed slot 33 with the upper termination 34 being axially positioned corresponding to the upper termination 31 of the longer slot 32 and the lower internal termination of the shorter slot 35 being found in the lower tapered portion 36 of the bit holder shank 12. This lower tapered portion 36, in this preferred embodiment, is between 0.005 and 0.050 inches larger than the corresponding bit block bore of competitors' bit holder block at the axial location corresponding to same when the bit holder 10 is inserted in the bit block bore 13. This tapered portion 36 collapses radially, when the bit holder shank 12 is inserted in the bit block bore 13 elastically to an extent that provides sufficient radial force to maintain the bit holder shank in the bit block bore during use.

A decreased size distal end portion 37 depends from the bottom of the lowered tapered segment 36 and, as shown most clearly in FIG. 3, is positioned to extend outwardly of the bottom 40 of the bit block 14 when the bit holder 10 is mounted therein. The bottom distal portion 37 is a general C-shape when viewed from the bottom 24 of the bit holder 10.

In the preferred configuration, as shown most clearly in FIG. 3, when the bit holder 10 is inserted in the bit block bore 13, the interference between both the upper shank portion 27 and the lower tapered portion 36 need only be forced during approximately the last ½ to 1¼ inch of insertion. As mentioned previously, a forked extraction tool (not shown) may be inserted between the lower tapered portion 20 of the bit holder body tire portion 18 and the top 28 of the bit block bore 13 to more easily remove the bit holder 10 from the bit block 14. Additionally, the distal end portion 37 of the bit holder shank 12 extends outwardly of the bottom 40 of the bit block 14 approximately ¼ to ⅝ inch and, if necessary, may provide a means for driving the bit holder 10 partially from the bit block 14 when desired. An upper portion 41 of the preferred bit block bore 13, in this embodiment it is about 1.665 inches in dimension adjacent the top, is enlarged from the one degree taper of the remainder of the bore to about a 5.5 to 7.0 degree per side taper to receive the enlarged upper band 27 of the bit holder shank 12 therein.

As indicated previously, the generally cylindrical top portion 16 of the bit holder body 11 provides increased mass and therefore increased toughness of the upper portion of the bit holder than heretofore utilized in competitor's bit holders. This increased diameter top portion 16 also provides an increased cross section for the insertion of the shank (not shown) of a bit into the larger diameter bore 23 of the top of the bit holder 10.

As shown most clearly again in FIG. 3, the fact that the preferred first embodiment 10 has the tire portion resting on the top surface of the bit block differs from that of certain manufacturers of bit holders and bit blocks wherein the bottom surface of the bit holder body is spatially related to the top surface of the bit block allows for more simple tooling to be utilized to extract the bit holder from the bit block.

Thus, a preferred embodiment of the present invention have been shown and described. It will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. A bit holder for use in road milling comprising:

a bit holder body including a bottom defining an annular flange perpendicular to a central axis thereof; and a generally hollow axially oriented slotted shank depending from the bottom of said body, said shank comprising:

a slot that includes an upper terminal portion spatially oriented along said shank from said annular flange;

a first portion between said annular flange and said upper terminal portion of the slot, said first portion including an outer declining taper surface toward a distal end of said shank between greater than zero and about a 7 degree angle per side thereof;

a second portion adjacent the first portion, the second portion including the upper terminal portion of the slot, the first portion including an increased diameter from the second portion;

a radially inwardly extending shoulder between the first portion and the second portion; and an axial height of said first portion being between about ½ inch and ⅞ inch, said first portion terminating at said shoulder.

2. The bit holder as defined in claim 1 wherein the bit holder body comprises a tire portion upwardly adjacent the bottom annular flange of the bit holder body, the tire portion including a first pair of spatially related parallel undercuts extending inwardly from the bottom annular flange of the bit holder body, said undercuts being a hollow wedge shape, the declining terminuses of said undercuts ending short of a plane through an axis of said bit holder body.

3. The bit holder as defined in claim 2 further including a second pair of spatially related parallel undercuts positioned opposite a central plane through an axis of said bit holder body from said first pair of undercuts.

4. The bit holder as defined in claim 2 wherein the tire portion comprises a radially inward outer annular tapered portion adjacent the bottom of the bit holder body, wherein a height of the radially inward outer annular tapered portion is approximately a top height of said undercuts, said undercuts and said annular tapered portion configured to provide voids for insertion of an extraction tool therein.

5. The bit holder of claim 4, wherein the radially inward outer annular tapered portion is at about a 45 degree angle to the bottom of the bit holder body.

6. The bit holder as defined in claim 1, wherein said outer declining taper surface is approximately a 6 degree angle per side with the central axis of the shank.

7. The bit holder as defined in claim 1, wherein said outer declining taper surface is between a 5 degree angle per side to a 7 degree angle per side with the central axis of the shank.

8. The bit holder of claim 1, further comprising:

a rounded junction between a forward end of the first portion of the shank and the bit holder body, the rounded junction adapted to avoid sharp corners and relieve stress cracking.

9. A bit holder for use in road milling comprising;

a bit holder body including a bottom defining an annular flange perpendicular to a central axis thereof; and a generally hollow axially oriented slotted shank depending from the bottom of said body, said shank comprising:

a slot that includes an upper terminal portion spatially oriented along said shank from said annular flange;

a first portion between said annular flange and said upper terminal portion of the slot;

a second portion adjacent the first portion, the second portion including the upper terminal portion of the slot, the first portion including an increased diameter from the second portion;

a radially inwardly extending shoulder between the first portion and the second portion;

said first portion including an outer declining taper surface toward a distal end of said shank between greater than zero and about a 7 degree angle per side thereof, wherein the surface comprises a taper configured to form a fit between the shank first portion and a base block bore of a base block with the combination of axial movement of the shank into the base block bore and the bit holder body seating on a surface of said base block retaining the bit holder on the base block; and an axial height of said first portion being between about ½ inch and ⅞ inch said first portion terminating at said shoulder.

10. The bit holder of claim 9, further comprising:

a rounded junction between a forward end of the first portion of the shank and the bit holder body, the rounded junction adapted to avoid sharp corners and relieve stress cracking.

11. A bit holder comprising:

a bit holder body comprising a bottom defining an annular flange perpendicular to a central axis thereof; and a generally cylindrical hollow shank axially depending from the bottom of said bit holder body, the shank comprising:

a slot including an upper terminal portion spatially oriented along said shank from said annular flange;

a first portion between said annular flange and said upper terminal portion of the slot, the first portion including an outer declining taper surface toward a distal end of said shank between greater than zero and about a 7 degree angle per side thereof;

a second portion adjacent the first portion, the second portion including the upper terminal portion of the slot, the first portion including an increased diameter from the second portion;

a radially inwardly extending shoulder between the first portion and the second portion; and an axial height of said first portion being between about ½ inch and ⅞ inch, said first portion terminating at said shoulder.

12. The bit holder of claim 11, further comprising:

a rounded junction between a forward end of the first portion of the shank and the bit holder body, the rounded junction adapted to avoid sharp corners and relieve stress cracking.

13. The bit holder of claim 11, wherein the axial height of said first portion being between ½ and ¾ inch.

* * * * *